United States Patent [19]

Crawford et al.

[11] 3,977,550

[45] Aug. 31, 1976

[54] SIDE HANDLING ATTACHMENT

[75] Inventors: John T. Crawford, Lyndhurst, Ohio; Walter M. Shaffer, Peoria, Ill.

[73] Assignee: Towmotor Corporation, Mentor, Ohio

[22] Filed: Nov. 18, 1974

[21] Appl. No.: 524,692

[52] U.S. Cl. ..... 214/730; 214/16.4 A

[51] Int. Cl.[2] ..... B66F 9/14

[58] Field of Search ..... 214/730, 731, 16.4 R, 214/16.4 A, 95 R

[56] References Cited

UNITED STATES PATENTS

| | | | |
|---|---|---|---|
| 3,357,582 | 12/1967 | Wittek | 214/730 |
| 3,596,789 | 8/1971 | Aaronson et al. | 214/730 |
| 3,762,589 | 10/1973 | Shaffer | 214/730 |

*Primary Examiner*—Robert J. Spar
*Assistant Examiner*—Lawrence J. Oresky
*Attorney, Agent, or Firm*—Phillips, Moore, Weissenberger, Lempio & Strabala

[57] ABSTRACT

An attachment for use on a fork lift truck includes a base portion, and stabilizer bars movable relative thereto, laterally of the truck. The attachment also includes a platform movable relative to the base means laterally of the truck, and actuating means, including pulley and cable means, are utilized to initially move the stabilizer bars laterally of the truck, for engagement with a storage rack for stabilizing the fork lift truck. The platform is then shifted laterally to shift the load thereon. When this operation is completed, the platform is initially retracted, with the stabilizer bars in their outward or extended positions, and then the stabilizer bars themselves are retracted.

12 Claims, 12 Drawing Figures

SIDE HANDLING ATTACHMENT

BACKGROUND OF THE INVENTION

This invention relates to a side handling attachment for use on a fork lift truck, and more particularly, to such a side handling attachment which is capable of picking up and/or discharging a load laterally disposed on either side of the truck.

It is a well-known practice in the handling of material to utilize industrial fork lift trucks to move materials and other loads between storage areas or between a storage area and a work area. Such a truck generally includes lift forks mounted for vertical movement on the forward portion of the truck to support and carry the loads. In the case of certain material storage, it has been found highly desirable to provide tiered storage racks, so that each rack is fully accessible without moving any other rack. Narrow aisles are generally provided between such storage racks, and it will be seen that it is desirable to hold the widths of such aisles to a minimum so as to utilize maximum storage space in the storage building. Such narrow aisles make it difficult, if not impossible, for conventional lift trucks to turn so as to face a material-supporting rack.

Retrieval mechanisms which are specifically designed for use with a vehicle in the above-stated environment are generally quite complicated and expensive, and still often require that the aisle be wider than would be necessary for passage of the fork lift truck itself therethrough. In general, see U.S. Pat. No. 3,804,318 to Sylvester et al, U.S. Pat. No. 2,941,686 to Sylvester et al, U.S. Pat. No. 3,050,205 to Coash et al, U.S. Pat. No. 3,154,208 to Barrett, U.S. Pat. No. 2,958,436 to Skutle et al, U.S. Pat. No. 3,232,465 to Romine et al, U.S. Pat. No. 3,549,025 to Messner, and U.S. Pat. No. 3,586,183 to Shaffer, this last patent assinged to the assignee of this invention. Each of these patents disclose apparatus including load bearing means which may be shifted laterally of the main frame thereof. However, none of these patents disclose a load handling apparatus wherein bar means are movable to an outward position relative to base means, with the actual load engaging means remaining in an inward position relative to the base means, with subsequent movement of the load engaging means to an outward position thereof with the bar means still in its outward position.

SUMMARY OF THE INVENTION

It is accordingly an object of this invention to provide a side loading device particularly suited for use with a lift truck, and which may operate in a relatively narrow aisle between loading racks.

It is further an object of this invention to provide a side loading device which, while fulfilling the above object, provides for stable and proper handling of the load involved.

It is a still further object of this invention to provide a side loading device which, while fulfilling the above objects, utilizes stabilizer bars which are themselves laterally extendable and retractable to provide a high degree of stabilization of the device.

It is a still further object of this invention to provide a side loading device which, while fulfilling the above objects, is simple in operation and convenient to use.

Broadly stated, the invention comprises a load-handling apparatus comprising base means, and track means associated with the base means. Bar means are movable relative to the base means generally along the track means to an outward position relative to the base means, and to an inwrd position relative to the base means. Platform means are movable relative to the base means generally along the track means to an outward position relative to the base means, and to an inward position relative to the base means. The bar means are movable to such outward position thereof with the platform means remaining in its inward position, and the platform means are movable to such outward position thereof with the bar means in its outward position.

BRIEF DESCRIPTION OF THE DRAWINGS

These and other objects of the invention will become apparent from a study of the following specification and the drawings in which:

FIG. 8 is a sectional view taken along the line VIII—VIII of FIG. 1;

FIG. 9 is a sectional view taken along the line IX—IX of FIG. 6;

DESCRIPTION OF THE PREFERRED EMBODIMENT

Figure 1:
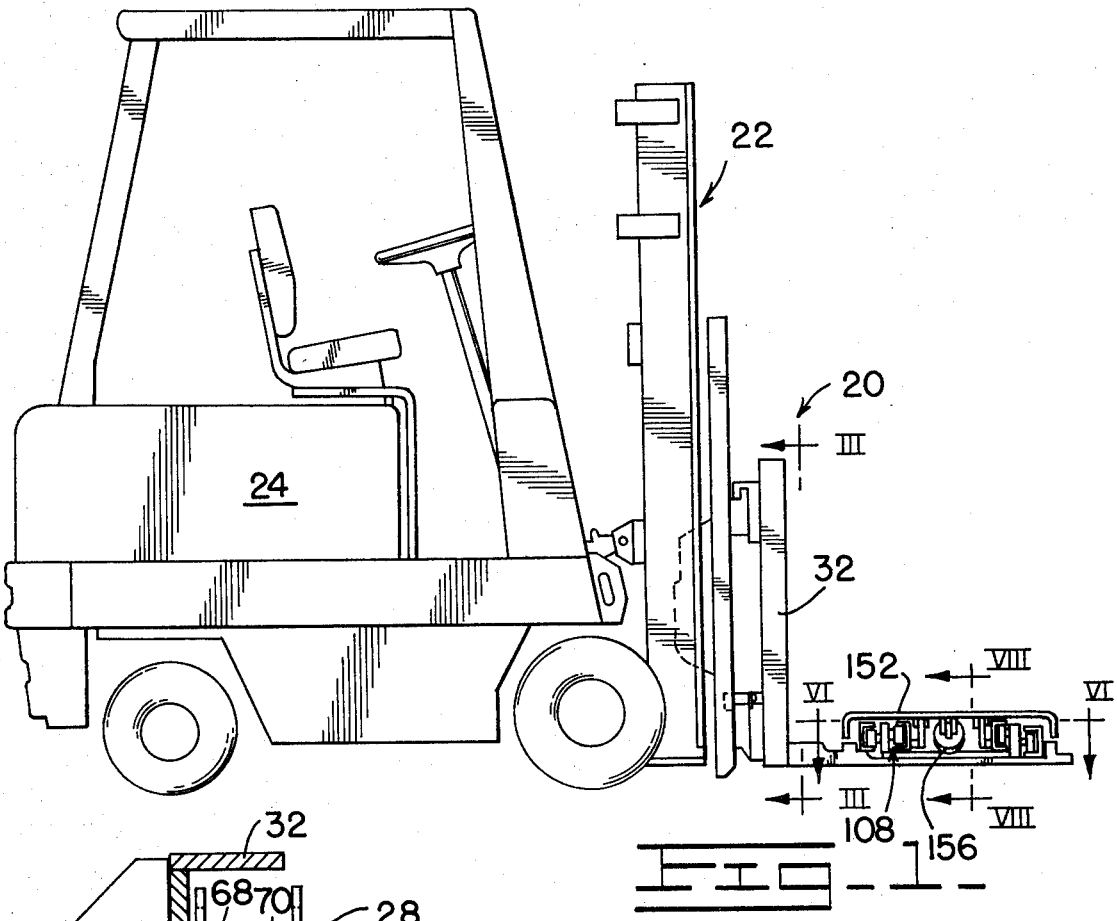
FIG. 1 is a side-elevation of a fork lift truck incorporating the inventive handling apparatus.

Referring to FIG. 1, a load-handling apparatus in the form of a side-handling attachment is generally indicated by the reference numeral 20, and is attached to a telescoping mast 22 of a fork lift truck 24. As more clearly shown in FIGS. 2 and 3, the apparatus 20 includes an assembly 26 which includes a main assembly body 28. The main assembly body 28 includes a main body frame 30 which if fabricated from a plurality of plates 32 fastened together as by welding, and first, second and third cross-members 34,36,38 which extend between the outer side plates 32 of the main body frame 30. Such cross-members 34,36,38 are fixed to the outer side plates 32, and are in parallel relation, with the cross-member 36 disposed generally between the corss-members 34,38. Base means 40 in the form of a plurality of U-shaped channel members 41,42,43 extend forwardly from the lower portion of the assembly 28 and have their rearward ends attached to the main body frame 30.

Figure 4:
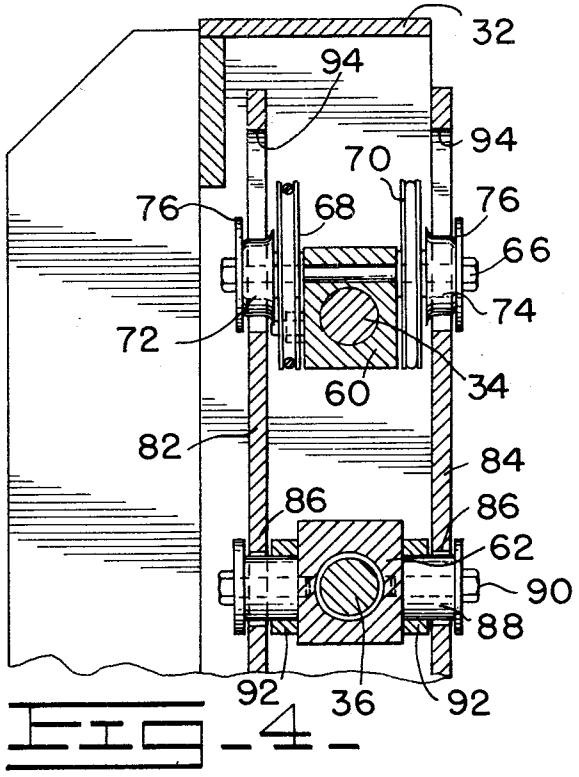
FIG. 4 is a sectional view taken along the line IV—IV of FIG. 3.

A plurality of rollers 44,46,48,50,52,54,56,58 are rotatably supported by suitable brackets fixed to the frame 30. Rectangular cross-heads 60,62,64 are slidably disposed on the cross-members 34,36,38 respectively. As best seen in FIG. 4, a bolt 66 extends through the cross-head 60 normal to the cross member 34 and rotatably supports a pair of pulleys 68,70 disposed on the rear and front sides, respectively, of the cross-head 60. The pulley 68 is in substantial alignment with pulley 44, while pulley 70 is in substantial alignment with pulley 52. A pair of rollers 72, 74 are rotatably supported on the bolt 66, with each roller 72,74 being disposed between a retaining plate 76 and a respective one of the pulleys 68,70. A pair of pulleys 78,80 (FIG. 2) and a pair of rollers are similarly supported on a bolt 81 extending through the cross-head 64.

A pair of spaced actuating members 82,84 are individually disposed on the rearward and forward sides of the cross-heads 60,62,64, with each actuating member 82,84 having a portion 86 (best shown in FIG. 4) which is pivotally supported upon a bearing 88 which is secured to the cross-head 62 by a bolt 90. A spacer 92 is disposed between the cross-head 62 and each actuating member 82,84. The actuating members 82,84 are secured relative to each other by pins which extend between them.

Figure 2:
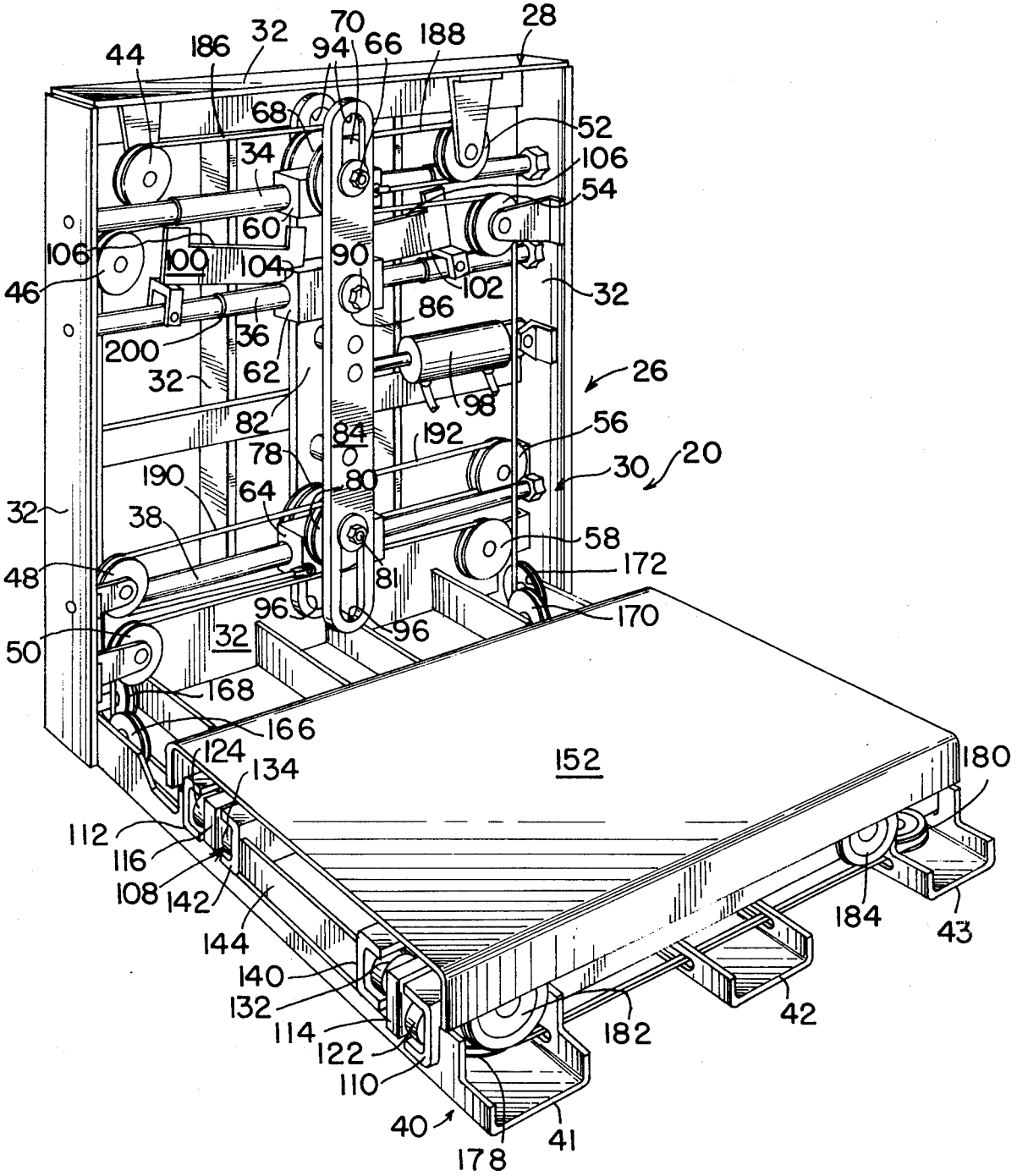
FIG. 2 is a perspective view of the handling apparatus.
Figure 3:
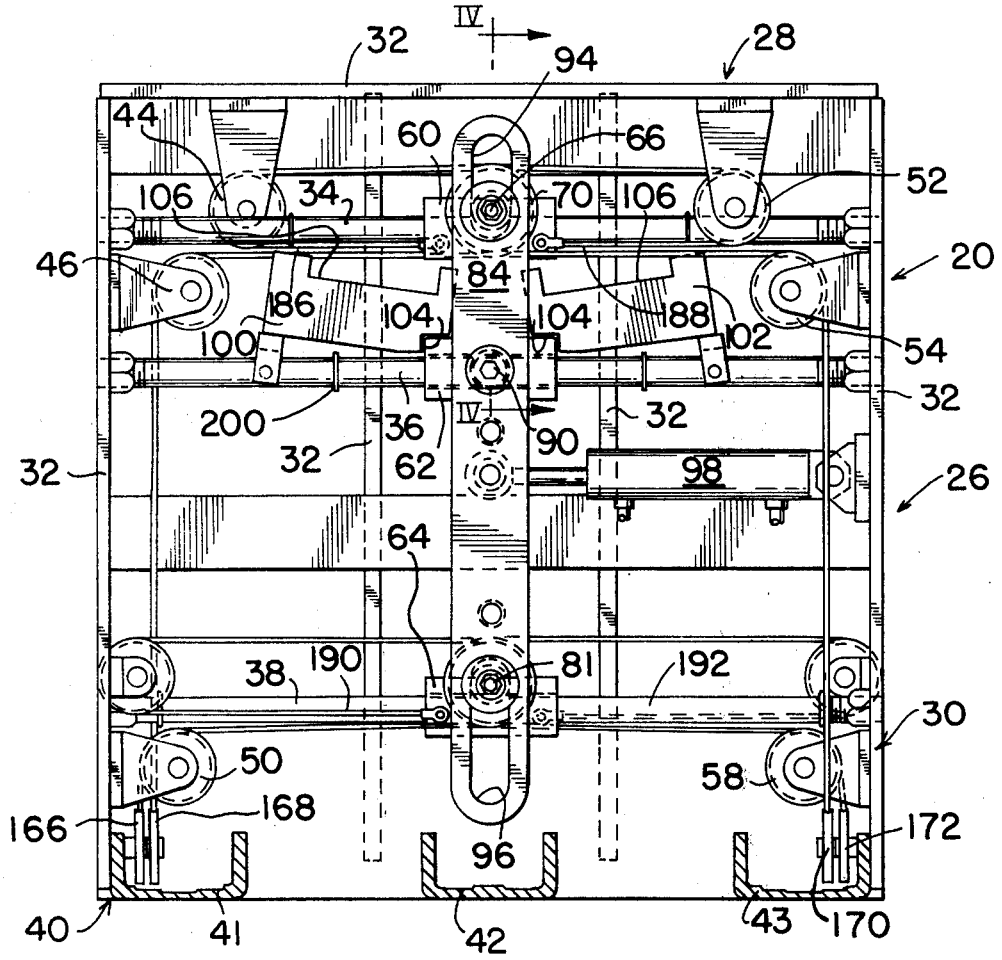
FIG. 3 is a view, partially in section, taken along the line III—III of FIG. 1.

As best shown in FIGS. 2 and 3, the distance between the bolts 81,90 is twice the distance between the bolts 66,90. A pair of elongated slots 94,96 are formed in the upper and lower ends respectively of each actuating member 82,84. The elongated slots 94 receive the rollers of the cross-head 60, while the elongated slots 96 receive the rollers attached to the cross-head 64.

It will be seen that each actuating member 82,84 has portions pivotably associated with the cross-heads 60,62,64 respectively. An extendable and retractable hydraulic cylinder 98 interconnects an outer side plate 32 and the actuating members 82,84.

A pair of transversely-oriented camlocks 100,102 (FIGS. 2 and 3) are disposed above the cross-member 36. The outer end of each camlock is pivotally connected to the cross-member 36. An L-shaped notch 104 is formed on the lower inner corner of each camlock 100,102. A substantially U-shaped notch or recess 106 is formed in the upper edge of each camlock 100,102.

Figure 5:
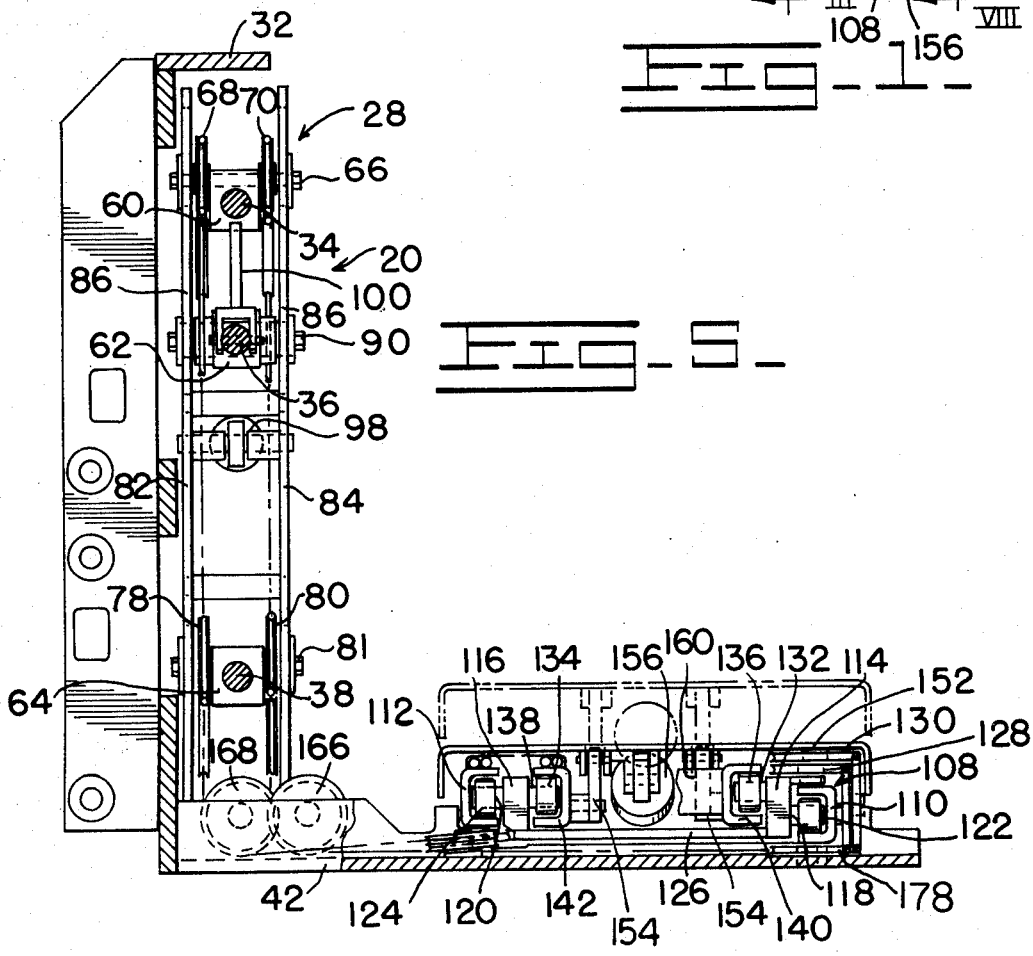
FIG. 5 is a sectional side-elevation of the handling apparatus.
Figure 5:
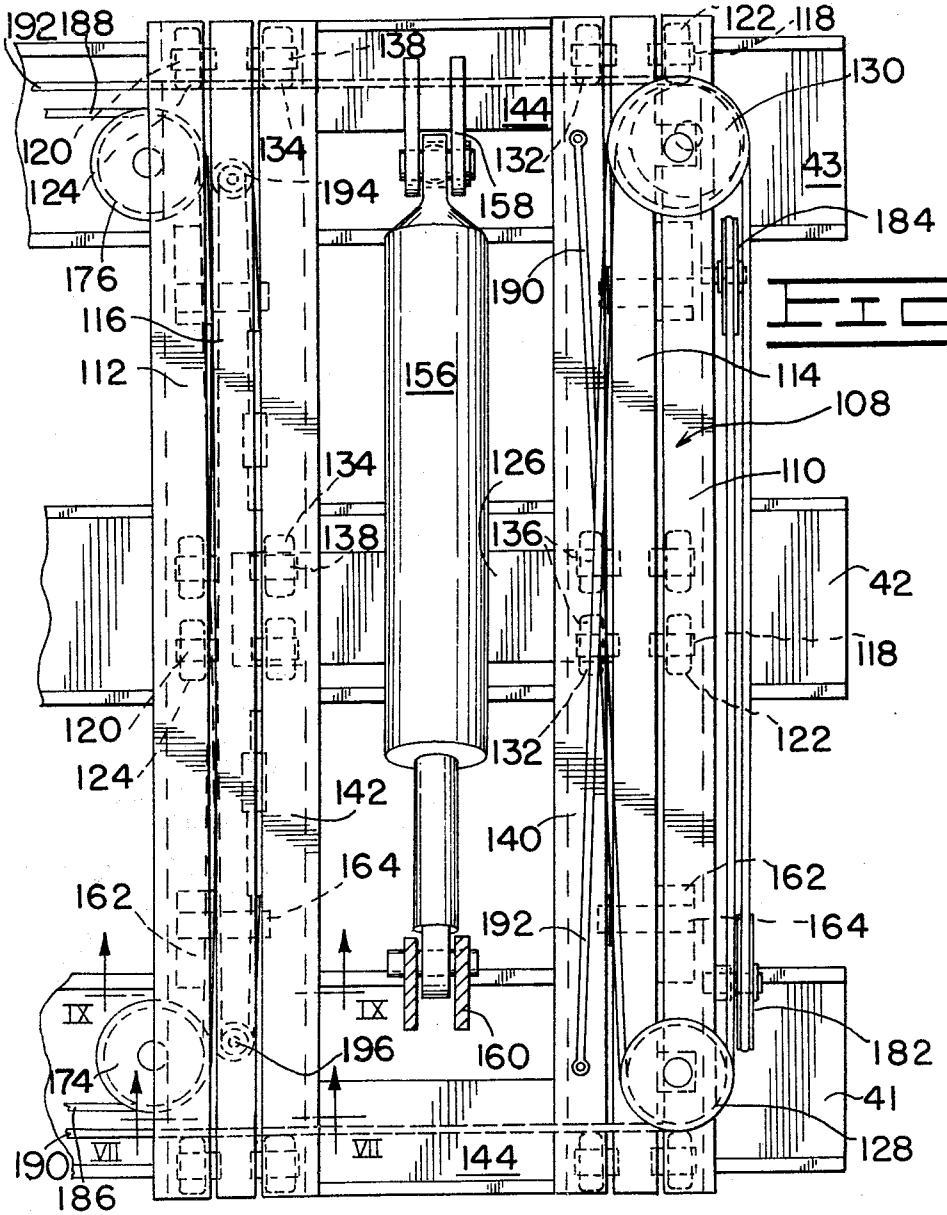
Figures 5, 6:
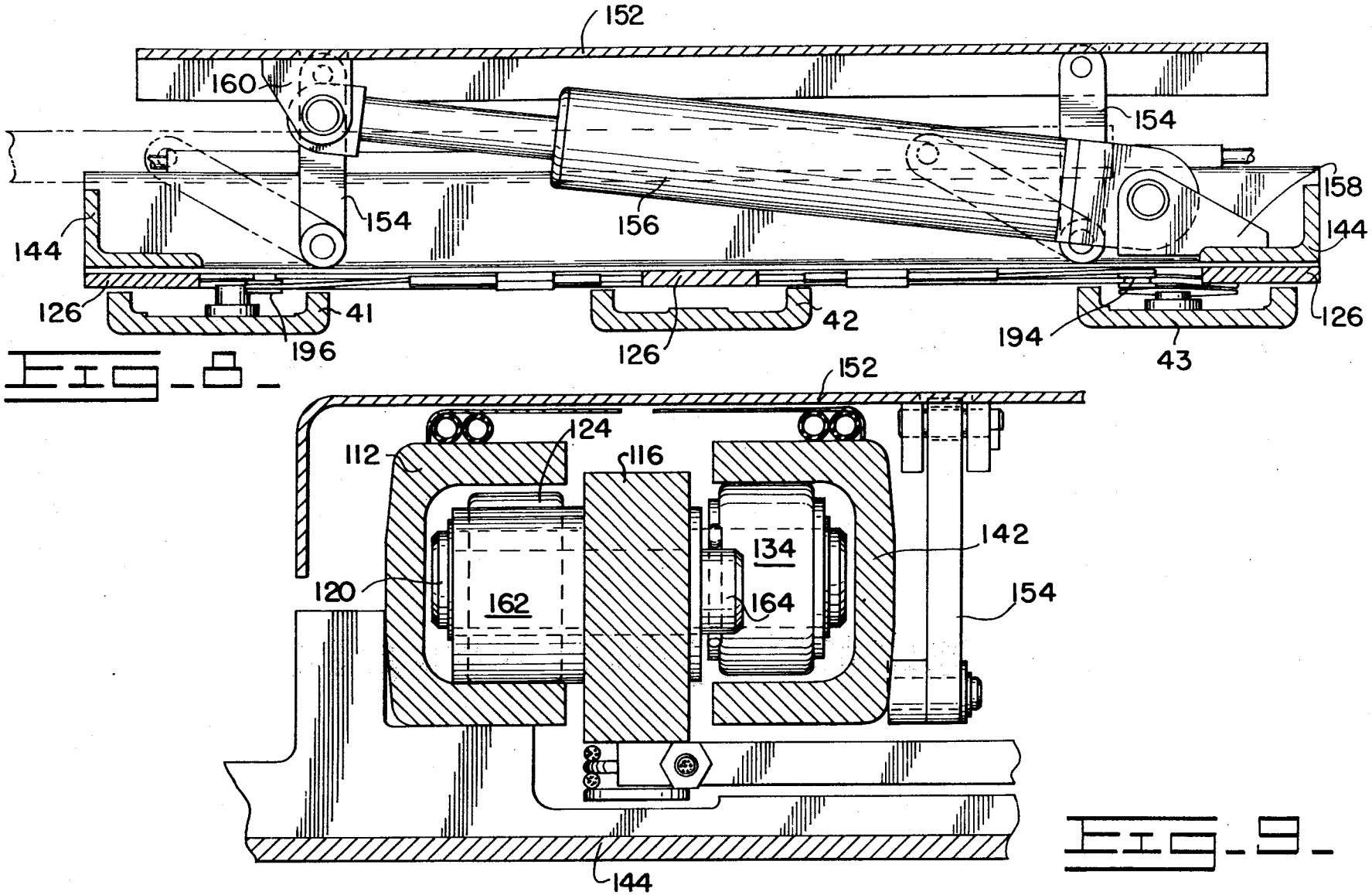
FIG. 6 is a view, partially in section, taken along the line VI—VI of FIG. 1.

As best shown in FIGS. 2, 5 and 6, a platform support mechanism 108 is supported by the channel members 41,42,43. Such platform support mechanism 108 takes the form of track means made up of channel members 110,112 rigidly fixed to the channel members 41,42,43 with the U-shaped openings of the channel members 110,112 facing each other. A pair of stabilizer slide bars 114,116 are disposed intermediate the channel members 110,112, with each slide bar being adjacent to and inward of a channel member. A plurality of shafts 118,120 are rigidly secured to the stabilizer slide bars 114,116 respectively, and extend into the U-shaped openings of the channel members 110,112 respectively. A plurality of rollers 122,124 are individually rotatably mounted on the shafts 118,120 and are rollingly supported by the channel members 110,112. A plurality of spaced parallel plates 126 (FIGS. 5 and 8) extend between and are rigidly secured to the lower edges of the stabilizer slide bars 114,116. Pulleys 128,130 (FIGS. 5 and 6) are rotatably mounted on brackets which are individually secured to opposite ends of the stabilizer slide bar 114. A plurality of rollers 132,134 are individually rotatably mounted on a plurality of shafts 136,138 which are secured to the adjacent sides of the stabilizer slide bars 114,116 respectively.

A pair of spaced channel members 140,142 are disposed intermediate the stabilizer slide bars 114,116 and have their adjacent ends interconnected by angle members 144. Each channel member 140,142 is disposed inwardly of a bar 114,116, and such channel members 140,142 are arranged so that the rollers 132,134 are disposed within the U-shaped openings of the channel members 140,142, with the channel members 140,142 being supported by the rollers 132,134.

Figure 7:
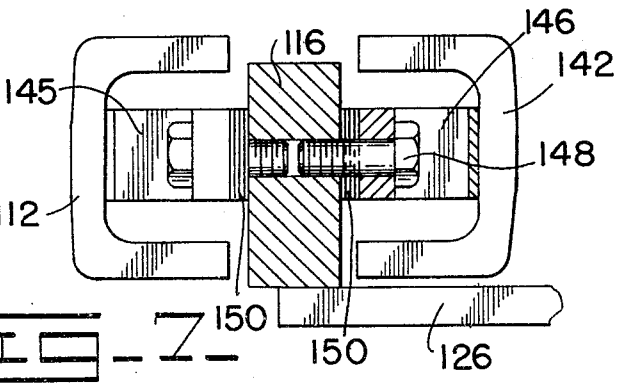
FIG. 7 is a sectional view taken along the line VII—VII of FIG. 6.

As best shown in FIG. 7, the longitudinal spacing of the channel member 112, stabilizer slide bar 116, and channel member 142 is maintained by a plurality of guide members 145,146 laterally spaced along and secured to the stabilizer slide bar 116 by a plurality of bolts 148. The guide members 145,146 are provided in pairs, with each being secured to an opposite side of the stabilizer slide bar 116. A plurality of shims 150 are disposed between the guide members 145,146 and the stabilizer slide bar 116 to provide a loose sliding fit between the guide member and the respective channel member.

As most clearly shown in FIG. 8, a platform 152 is pivotally secured to the upper ends of a plurality of links 154, which have their lower ends pivotally connected to the respective channel members 140,142 to form a parallelogram-type linkage. A hydraulic jack 156 has its head pivotally secured to a bracket 158 secured to the respective angle member 144 while the rod end is pivotally secured to a bracket 160 fastened to a lower side of the platform 152. Extending the jack 156 causes the platform 152 to be lowered from the solid-line position to the phantom-line position, and vice versa. It will be seen that, through the above-described apparatus, the bars 114,116 are allowed to move generally along the channel members 110,112, and the platform 152 is allowed to move generally along the bars 114,116, and the channel members 110,112. Also, extension and retraction of the jack 156 provides for upward and downward movement of the platform 152 relative to the channel members 110,112.

Figure 11:
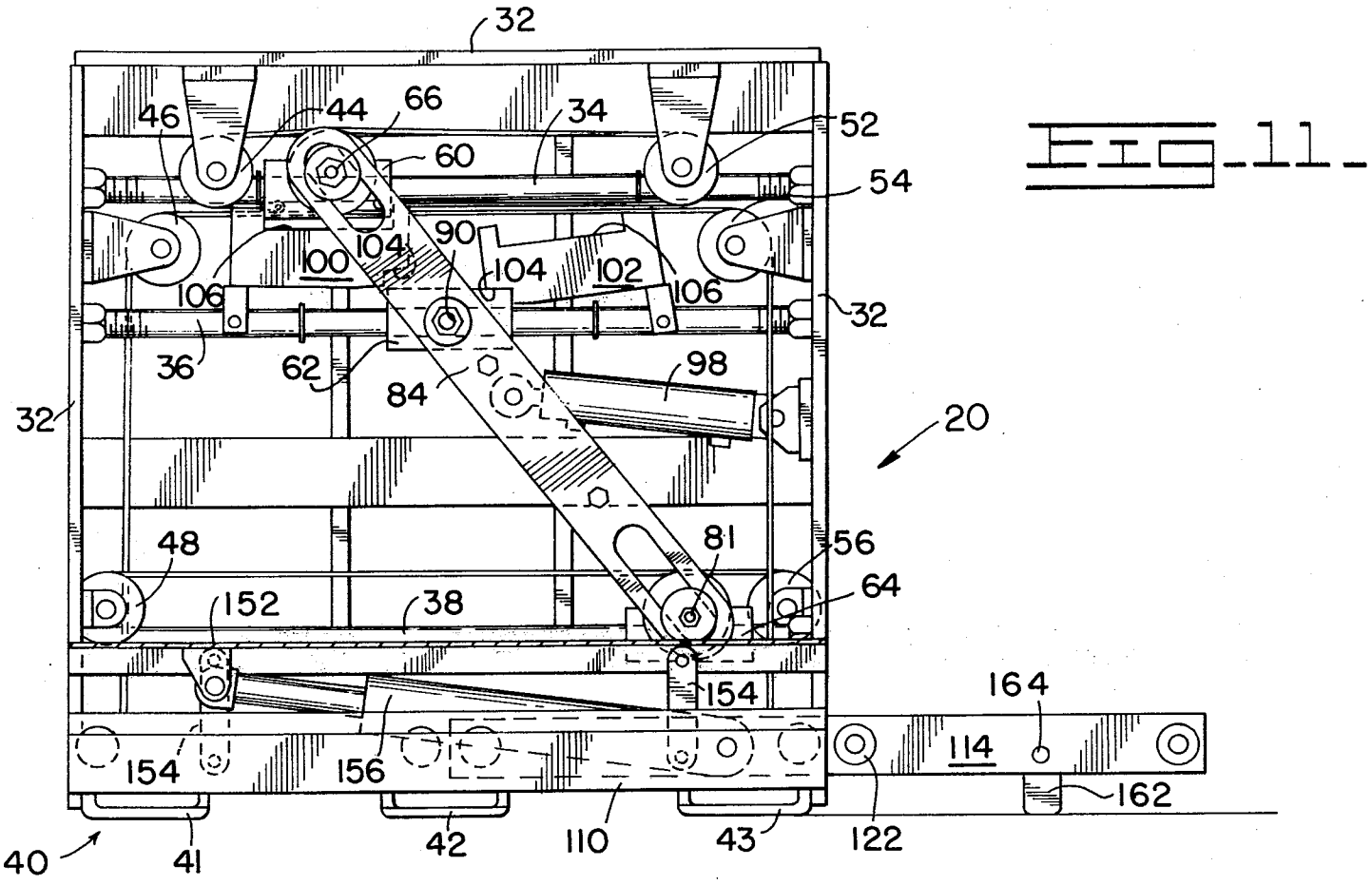
FIG. 11 is a front-elevation of the apparatus, showing the stabilizer bar means in its extended position.

As most clearly shown in FIGS. 6, 9 and 11, a plurality of stabilizer links 162 are pivotally mounted on a respective plurality of pins 164, which are in turn individually secured to the stabilizer slide bars 114,116 at the ends thereof. With the platform support mechanism in the position shown in FIG. 2, the stabilizer links 162 are disposed within the respective channel members 110,112 and are slidable therein.

Figure 10:
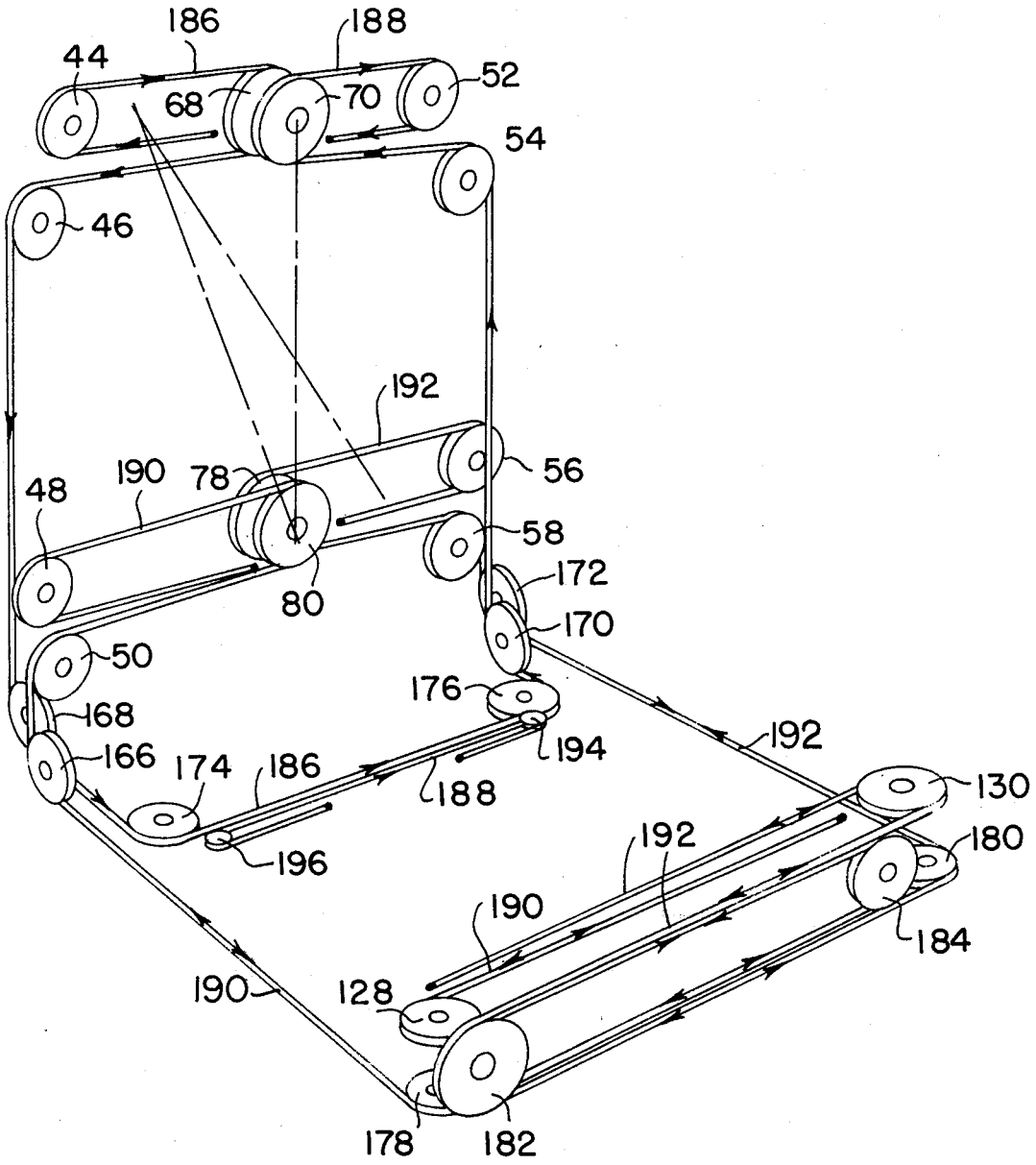
FIG. 10 is a perspective view of the pulley and cable system of the apparatus.

As most clearly shown in FIGS. 2 and 10, a pair of vertical pulleys 166,168 are rotatably secured within the channel member 41 adjacent to the frame 30. Another pair of vertical pulleys 170,172 are rotatably secured within the channel member 43 adjacent to the frame 30. A pair of horizontal pulleys 174,176 (FIG. 6) are individually rotatably mounted within the channel members 41,43 adjacent to the channel member 112. The grooves of the pulleys 174,176 are in line with the grooves of pulleys 168,172 respectively. Another pair of horizontally-disposed pulleys 178,180 (FIG. 2) are individually rotatably mounted within the forward end of the channel members 41,43 vertically below the channel member 110. A pair of vertical transversely-disposed pulleys 182,184 are rotatably secured to the forward face of the channel member 110 adjacent to its outer ends.

As best shown in FIGS. 2 and 10, a pair of cables 186,188 are employed for moving the stabilizer slide bars 114,116, as will hereinafter be described, while a pair of cables 190,192 are employed for side-shifting the platform 152. Cable 186 has an end secured to the backside of the cross-head 60 (FIG. 3), and extends laterally outwardly therefrom toward pulley 44. The cable makes a 180° wrap around pulley 44, another 180° wrap around pulley 68, a 90° wrap around pulley 46, a 90° wrap around the pulley 168, a 90° wrap around the pulley 174, and a 180° wrap around a rigid post 194 (FIG. 8), with its end being fixedly secured to the bottom of the stabilizer slide bar 116. Similarly, the cable 188 has one end attached to the forward side of the cross-head 60, makes a 180° wrap around the pulleys 52,70, a 90° wrap around the pulleys 54,170,176, and a 180° wrap around a post 196 fastened to the bottom side of the stabilizer slide bar 116 with the end of the cable 188 also being secured to the stabilizer slide bar 116.

The cable 190 has one end attached to the forward side of the cross-head 64 (FIG. 2), makes a 180° wrap around pulleys 48,80, a 90° wrap around pulleys 50,166,178, a 180° wrap around pulleys 184,128, and has its other end attached to the channel member 140 adjacent its rightward end. Similarly, the cable 192 has one end attached to the rear side of the cross-head 64, makes a 180° wrap around the pulleys 56,78, a 90° wrap around the pulleys 58,172,180, a 180° wrap around the pulleys 182,130 and, has its other end attached to the left end of the channel member 140.

With the platform support mechanism 108 in its central position, with the slide bars 114,116 and platform 152 in their inward positions relative to the base means, the actuating members 82,84 are vertically oriented, as shown in FIGS. 2 and 3. Side-shifting of the slide bars 114,116 and platform 152 to outward positions relative to the base means 40 is accomplished in two steps. The first step is initiated by retraction of the Hydraulic cylinder 98, causing the actuating members 82,84 to pivot about the bolt 90. The pivoting movement of the actuating members 82,84 slides the cross-heads 60,64 along the associated cross-members 34,38. The cross-head 62 is held from movement along the cross-member 36 upon such initial retraction of the hydraulic cylinder 98 by its engagement with the notches of the camlocks 104. Due to the winding of the cables 186,188, a motion advantage is provided between the cross-head 60 and the stabilizer slide bars 114,116, so that upon movement of the cross-head 60 to the left a distance X, the cable 188 moves the stabilizer slide bars 114,116 to the right a distance three times that which the cross-head 60 moves, or a distance of 3X, to the position shown in FIG. 11. Thus, the travel of the bars 114,116 relative to the base means 40 is three times as great as the travel of the cross-head 60 relative to the cross-member 34. FIG. 11 shows the stabiizer slide bars 114,116 in their outward positions relative to the base means 40. As the stabilizer slide bars 114,116 move to the right, the stabilizer legs 164 on the right side thereof drop down about their pivot pins 162 under gravity load to the vertical position. Such legs 164 may engage a storage rack, so that the stabilizer slide bars 114,116 provide stability for the fork lift truck 24 prior to side-shifting of the platform 152.

The platform 114 remains in such central or inward position as will now be described. As the cross-head 60 moves to the left, the cross-head 64 is moved to the right a distance equal to 2X, because of the distances between bolts 66,90 and 81,90 as described above. The cables 190,192 as arranged above provide a 3-1 motion advantage such that cable 192 is unwound and cable 190 is wound a distance equal to 6X. However, since the pulleys 128,130 are mounted to the stabilizing slide bar 114, they have moved to the right a distance equal to 3X. The cables 190,192 as described above provide a 2-1 motion advantage about pulleys 128,130 respectively, thereby negating the movement of the cross-head such that the platform 152 remains in its central or inward position.

Figure 12:
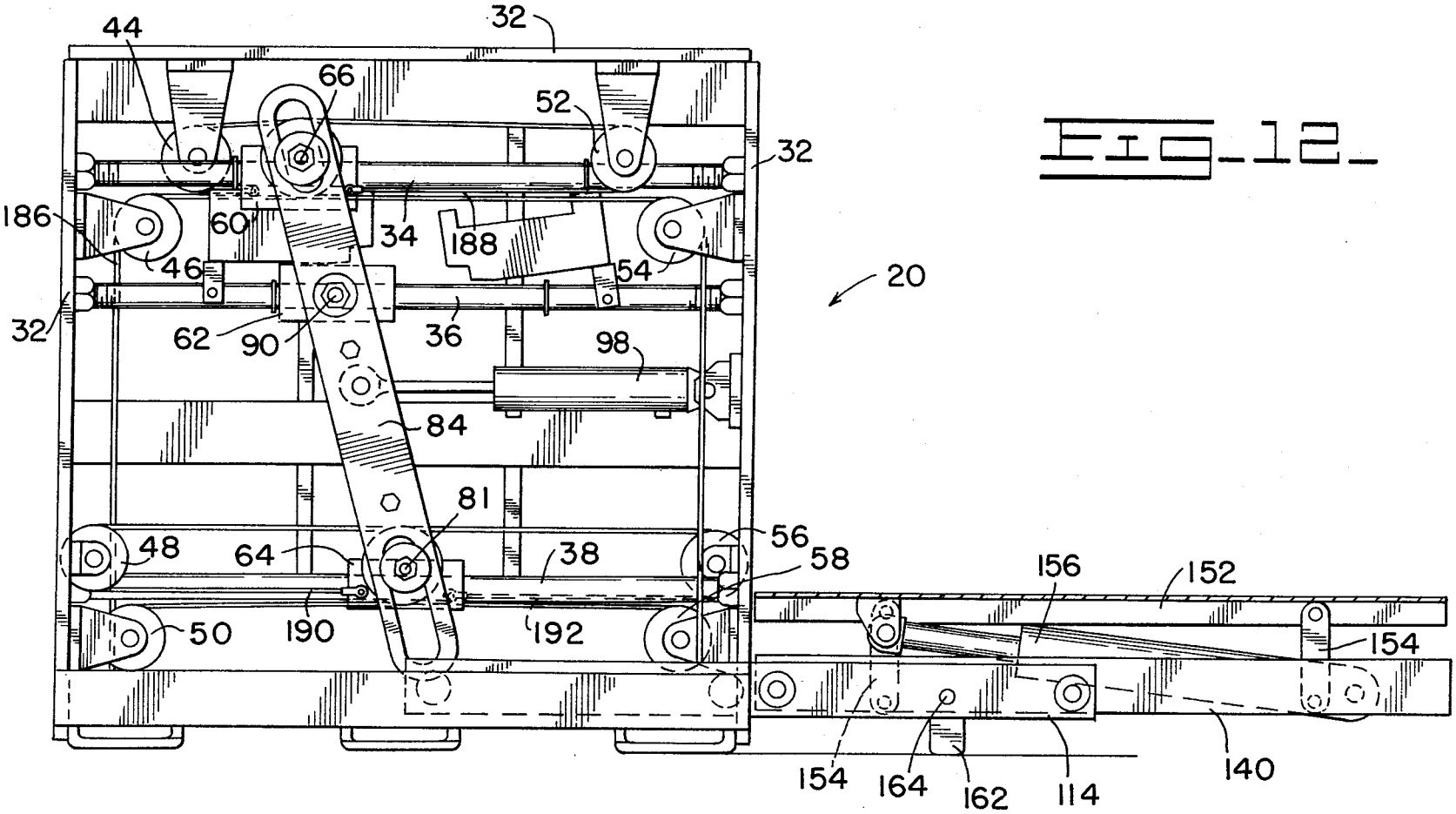
FIG. 12 is a view similar to that shown in FIG. 11, but showing the stabilizer bar means and platform means in their extended position.

As the cross-head 60 approaches its extreme leftward position, it engages the notch 106 of the camlock 100, causing the camlock 100 to pivot counterclockwise so that the notch 106 fully engages both ends of the cross-head 60. Such motion also frees the cross-head 62 for leftward movement along the cross-member 36. As shown in FIG. 12, the hydraulic cylinder 98 is then extended, and with the cross-head 60 being held relative to the cross-member 34 with the stabilizer slide bars 114,116 in their outward position, the actuating members 82,84 are caused to pivot about the bolt 66 of the cross-head 60 such that cross-head 64 is moved to the left a distance equal to 2X back to its central position. Cross-head 62 engages a stop-ring 200 to limit its leftward travel. Since the cables 190,192 are arranged to provide a 3-1 motion advantage, the channel members 140,142 and platform 152 are moved to the right to the outward positions thereof a distance equal to 6X, such outward position of the platform 152 being shown in FIG. 12. Thus, the travel of the platform 152 relative to the base means 40 is greater than the travel of any of the cross-heads relative to their associated cross-members.

Depending upon whether a load is to be picked up or set off, the platform 152 is either raised or lowered by proper actuation of the hydraulic jack 156. The platform 152 is then returend to its inward position by reversing the steps above, i.e., by retracting cylinder 98 to move the apparatus into the position shown in FIG. 11, wherein the platform 152 has been moved to its inward position with the stabilizer slide bars 114,116 in their outward positions. Subsequent extension of the cylinder 98 moves the stabilizer slide bars 114,116 to their inward positions with the platform 152 already in its inward position.

During the movement of the stabilizer slide bars 114,116 from their outward to their inward positions, the legs 162 contact the ends of the respective channel members, to pivot the legs 162 upwardly to their horizontal positions. The legs 162 are thereby automatically retracted during inward movement of the stabilizer bars 114,116, and such legs 162 continue to slide into the channel members with the movement of the slide bars 114,116.

It is to be seen and understood that while the outward positions of the stabilizer slide bars 114,116 and the platform 152 are shown as on one side of the base means 40, laterally of the vehicle 24, the device is capable of operation to move the stabilizer slide bars 114,116 and platform 152 to the other, opposite side of the base means 40. In such case, with the actuating members 82,84 in the position shown in FIG. 2, the hydraulic cylinder 98 is first extended, and subsequently retracted, which is exactly the opposite of the sequence described above. Upon such initial extension of the cylinder 98, the stabilizer slide bars 114,116 move relative to the base means 40 to an opposite outward position on the other side of the base means 40, with the platform 152 still in its inward position, and subsequent retraction of the cylinder 98 moves the platform 152 to an outward position on said other side of the base means 40, with the stabilizer slide bars 114,116 in such outward positions.

What is claimed is:

1. A load handling apparatus comprising:
raisable and lowerable base means;
means for raising and lowering said base means;
track means associated with the base means;
bar means movable relative to said base means generally along said track means to an outward position relative to said base means, and to an inward position relative to said base means;
load engaging means movable relative to said base means generally along said track means to an outward position relative to said base means, and to an inward position relative to said base means;
the bar means being movable to said outward position thereof with the load engaging means remaining in its inward position relative to the base means;
the load engaging means being movable to said outward position thereof with the bar means in its outward position;
wherein said track means comprise a pair of channel members fixed relative to the base means, wherein said bar means comprise a pair of bar members, each disposed inwardly of a channel member, and comprising roller means associating the respective channel members and bar members for allowing movement of the bar members generally along the channel members;
wherein the load engaging means comprise a platform, and a second pair of channel members associated therewith to move generally therewith, each of said second pair of channel members being disposed inwardly of a bar member, and roller means associating the respective second channel members and bar members for allowing movement of the platform generally along said bar members and said first-mentioned channel members.

2. The apparatus of claim 1 and comprising means for allowing upward and downward movement of the platform relative to the second channel members.

3. The apparatus of claim 2 wherein said means for allowing upward and downward movement of the platform relative to the second channel members comprise link means interconnecting the second channel members and platform.

4. The apparatus of claim 1 wherein the roller means associating the first channel members and the bar members comprise a first plurality of rollers fixed to said bar members and rollingly disposed in the respective associated first channel members, and wherein the roller means associating the second channel members and bar members comprise a second plurality of rollers fixed to said bar members and rollingly disposed in the respective associated second channel members.

5. A load handling apparatus comprising:
raisable and lowerable base means;
means for raising and lowering said base means;
track means associated with said base means;
bar means movable relative to said base means generally along said track means to an outward position relative to said base means, and to an inward position relative to said base means;
load engaging means movable relative to said base means generally along said track means to an outward position relative to said base means, and to an inward position relative to said base means;
leg means connected to said bar means and actuatable to automatically extend from the bar means as the bar means are moved to said outward position, and means for automatically retracting said leg means as said bar means are moved to said inward position.

6. The apparatus of claim 5 wherein said leg means are actuated to extend from the bar means by gravity, and wherein the means for automatically retracting said leg means comprise said base means, which contact said leg means as said bar means are moved to said inward position thereof.

7. The apparatus of claim 6 wherein said leg means comprise a plurality of legs pivotally fixed to said bar means.

8. A load handling apparatus comprising:
raisable and lowerable base means;
means for raising and lowering said base means;
track means associated with the base means;
bar means movable relative to said base means generally along said track means to an outward position relative to said base means, and to an inward position relative to said base means;
load engaging means movable relative to said base means generally along said track means to an outward position relative to said base means, and to an inward position relative to said base means;
the bar means being movable to said outward position thereof with the load engaging means remaining in its inward position relative to the base means;
the load engaging means being movable to said outward position thereof with the bar means in its outward position; and comprising means for moving said bar means to said outward position thereof with the load engaging means in its inward position, comprising an actuator assembly comprising a main body, an actuating member, extendable and retractable means interconnecting said actuating member and main body, and means for providing that, with the bar means and load engaging means in their inward positions, initial movement of the extendable and retractable means in one direction moves the actuating member to move the bar means to its outward position with the load engaging means remaining in its inward position, and subsequent movement of the extendable and retractable means in its other direction moves the actuating member to move the load engaging means to its outward position with the bar means in its outward position.

9. The apparatus of claim 8 wherein said main body comprises a main body frame and first, second and third cross-members fixed thereto, with the second cross-member disposed generally between the first and third cross-members, and further comprising first, second and third cross-heads, each slidably disposed on a cross-member, the actuating member having first, second and third portions pivotably associated with the first, second and third cross-heads respectively, and pulley and cable means associating the first and third cross-heads with the bar means and load engaging means, and means for holding the second cross-head from movement along the second cross-member upon initial movement of the extendable and retractable means, so that the actuating member pivots about the second cross-head-actuating member pivot, such pivoting movement sliding the first and third cross-heads along the associated first and third cross-members, the movement of the first and third cross-heads through said pulley and cable means moving the bar means to its outward position meanswhile with the load engaging means retained in its inward position.

10. The apparatus of claim 9 and means for holding the first cross-head relative to the first cross-member with the bar means in its outward position, and means for releasing the second cross-head relative to the second cross-member upon said holding of the first cross-head relative to the first cross-member, so that upon movement of the extendable and retractable means in said other direction, the actuating member pivots about the first cross-head-actuating member pivot, the second and third cross-heads sliding along the respective second and third cross-members during such pivoting, to move the load engaging means to said outward position thereof through the pulley and cable means.

11. The apparatus of claim 10 wherein the pulley and cable means are arranged to provide travel of the bar means relative to the base means greater than travel of any of the cross-heads relative to their associated cross members.

12. The apparatus of claim 11 wherein the pulley and cable means are arranged to provide travel of the load engaging means relative to the base means greater than travel of any of the cross-heads relative to their associated cross-members.

* * * * *